US008256876B2

(12) United States Patent
Murray

(10) Patent No.: US 8,256,876 B2
(45) Date of Patent: Sep. 4, 2012

(54) INK PASSAGEWAYS CONNECTING INLET PORTS AND CHAMBERS

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 219 days.

(21) Appl. No.: 12/750,752

(22) Filed: Mar. 31, 2010

(65) Prior Publication Data

US 2011/0242229 A1 Oct. 6, 2011

(51) Int. Cl.
*B41J 2/14* (2006.01)
*B41J 2/175* (2006.01)

(52) U.S. Cl. ..... 347/49; 347/85

(58) Field of Classification Search ..... 347/49, 347/66, 85, 86, 87
See application file for complete search history.

(56) References Cited

U.S. PATENT DOCUMENTS

| | | | | |
|---|---|---|---|---|
| 5,119,115 | A * | 6/1992 | Buat et al. | 347/86 |
| 5,706,040 | A | 1/1998 | Reid et al. | |
| 6,003,981 | A * | 12/1999 | Cameron et al. | 347/85 |
| 6,059,396 | A | 5/2000 | Choi | |
| 6,086,193 | A * | 7/2000 | Shimada et al. | 347/86 |
| 6,130,695 | A * | 10/2000 | Childers et al. | 347/85 |
| 6,331,054 | B1 * | 12/2001 | Seu et al. | 347/87 |
| 6,655,785 | B1 * | 12/2003 | Hilton et al. | 347/49 |
| 6,811,250 | B2 | 11/2004 | Buchanan et al. | |
| 2003/0156171 | A1 | 8/2003 | Yamaguchi et al. | |
| 2005/0068391 | A1 | 3/2005 | Inoue et al. | |

FOREIGN PATENT DOCUMENTS

| | | |
|---|---|---|
| EP | 1 078 769 A2 | 2/2001 |
| WO | WO 01/49499 A1 | 7/2001 |

OTHER PUBLICATIONS

R. A. Murray, "Ink Chambers for Inkjet Printer", U.S. Appl. No. 11/614,487, filed Nov. 9, 2009.

* cited by examiner

*Primary Examiner* — Anh T. N. Vo
(74) *Attorney, Agent, or Firm* — Peyton C. Watkins

(57) ABSTRACT

A printhead frame for an inkjet printhead assembly, the printhead frame includes a holding receptacle for at least one replaceable ink tank, the holding receptacle including a plurality of ink inlet ports disposed on a first wall; a plurality of ink chambers corresponding to the plurality of ink inlet ports, wherein at least a first ink chamber is adjacent the first wall and is directly opposite a first ink inlet port, a second ink chamber is not adjacent the first wall, and the first wall includes a first hole to fluidly connect the first ink inlet port and the first ink chamber; and a second wall adjoining the first wall and forming a part of the second ink chamber, the second wall including a first groove; wherein the first wall includes a second hole to fluidly connect a second ink inlet port and the first groove; and wherein the second wall includes a first hole to fluidly connect the second ink chamber and the first groove.

18 Claims, 11 Drawing Sheets

INK PASSAGEWAYS CONNECTING INLET PORTS AND CHAMBERS

FIELD OF THE INVENTION

The present invention relates generally to ink passageways in an inkjet printhead assembly having a replaceable ink tank, and more particularly to ink passageways for connecting a plurality ink inlet ports to a plurality of ink chambers.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge so that the printhead needs to be replaced when the ink is depleted, or the ink tank can be detachably mounted to the printhead so that only the ink tank itself needs to be replaced when the ink is depleted. Carriage mounted ink tanks typically contain only enough ink for up to about several hundred prints. This is because the total mass of the carriage needs be limited so that accelerations of the carriage at each end of the travel do not result in large forces that can shake the printer back and forth. As a result, users of carriage printers need to replace carriage-mounted ink tanks periodically depending on their printing usage, typically several times per year. Consequently, the task of replacing a detachably mounted ink tank should be simple and reliable within the printer.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

Commonly assigned U.S. patent application Ser. No. 11/614,487 discloses removal of air from the ink in a printhead, as well as ink chamber and printhead die mount substrate geometries that can facilitate air bubble removal. The disclosed ink chamber and die mount substrate geometries provide a more vertical pathway in the printhead for air bubble flow from the printhead die and from the ink inlet ports to an air space above the liquid ink level in the ink chambers, from which the air can then be extracted. In particular, the ink chambers have a staggered outlet port configuration, and the die mount substrate includes ink pathways having a staggered ink inlet configuration to receive ink from outlet ports of the ink chambers.

What is needed is a compact and low-cost printhead assembly including ink passageways providing fluid connection between a plurality ink inlet ports disposed on a wall and a corresponding plurality of ink chambers, where at least one ink chamber is adjacent the wall, and at least another ink chamber is not adjacent the wall.

SUMMARY OF THE INVENTION

The present invention is directed to overcoming one or more of the problems set forth above. Briefly summarized, according to one aspect of the invention, the invention resides in a printhead frame for an inkjet printhead assembly, the printhead frame comprising (a) a holding receptacle for at least one replaceable ink tank, the holding receptacle including a plurality of ink inlet ports disposed on a first wall; (b) a plurality of ink chambers corresponding to the plurality of ink inlet ports, wherein at least a first ink chamber is adjacent the first wall and is directly opposite a first ink inlet port, a second ink chamber is not adjacent the first wall, and the first wall includes a first hole to fluidly connect the first ink inlet port and the first ink chamber; and (c) a second wall adjoining the first wall and forming a part of the second ink chamber, the second wall including a first groove; wherein the first wall includes a second hole to fluidly connect a second ink inlet port and the first groove; and wherein the second wall includes a first hole to fluidly connect the second ink chamber and the first groove.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
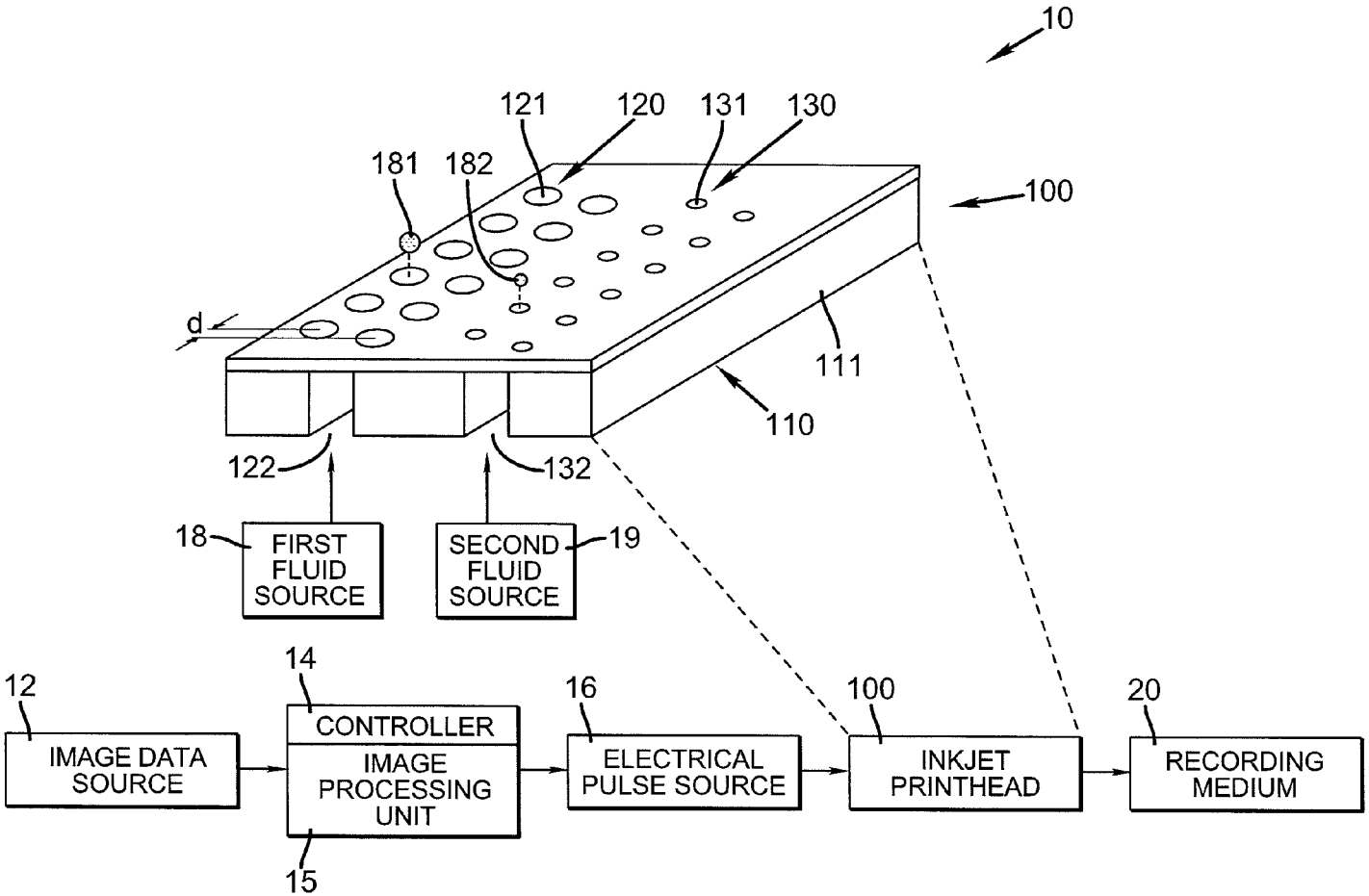
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. Each nozzle array is supplied by a fluid source. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
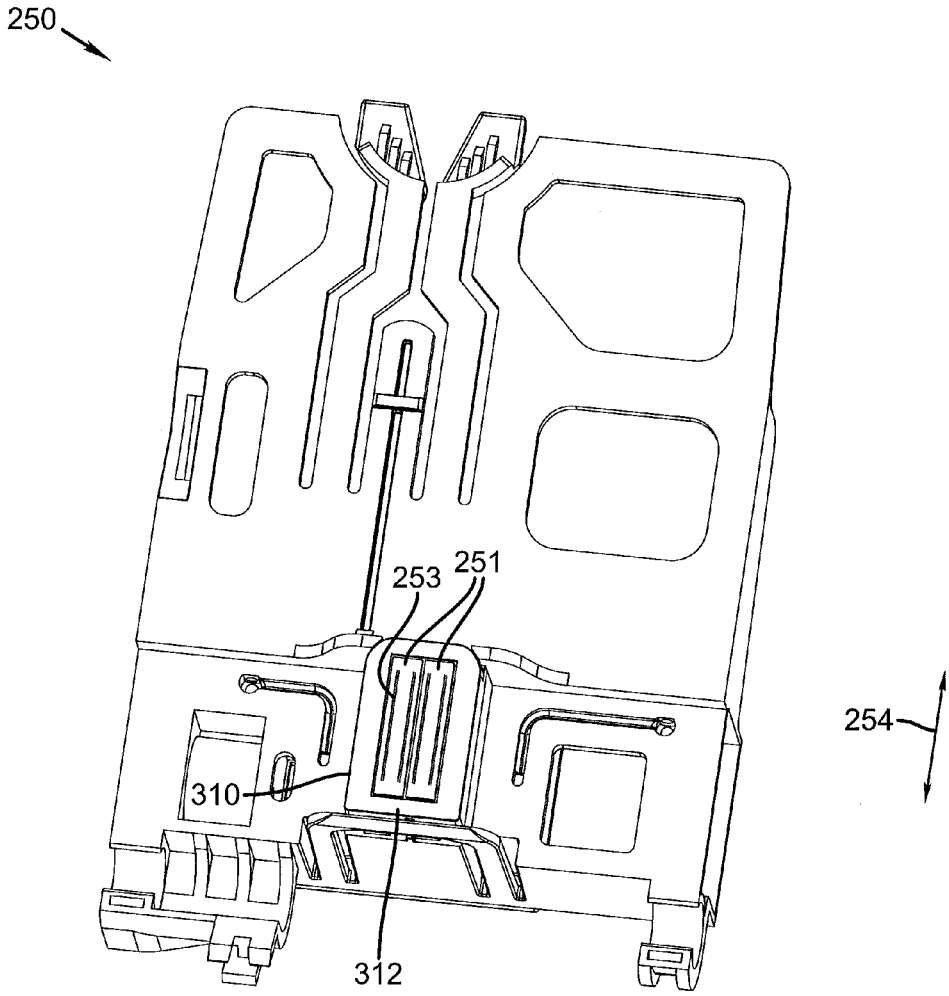
FIG. 2 is a bottom perspective view of a printhead assembly, according to an embodiment of the invention.

FIG. 2 shows a bottom perspective view of a printhead assembly, which is an example of an inkjet printhead 100. The printhead assembly includes printhead frame 250, as well as two printhead die 251 (similar to printhead die 110 in FIG. 1) mounted on die mount surface 312 of die mount substrate 310. Each printhead die 251 contains two nozzle arrays 253, so that printhead assembly 250 contains four nozzle arrays 253 altogether. The four nozzle arrays 253 in this example can each be connected to separate ink sources (not shown in FIG. 2); such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead frame 250 across the recording medium 20. Following the printing of a swath, the recording medium 20 is advanced along a media advance direction that is substantially parallel to nozzle array direction 254.

Figure 3:
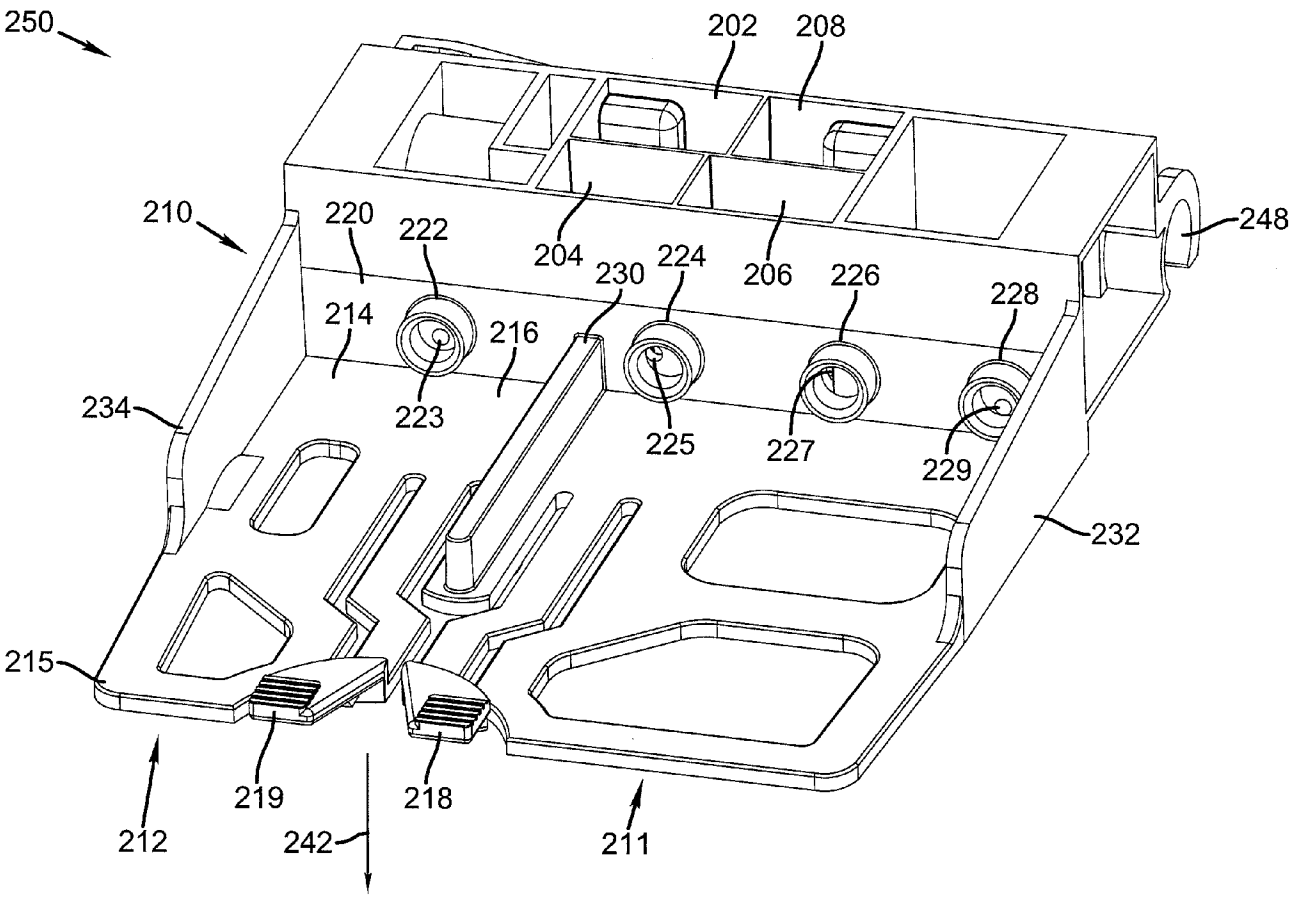
FIG. 3 is a perspective view of a printhead frame including a holding receptacle for two detachable ink tanks.
Figure 4:
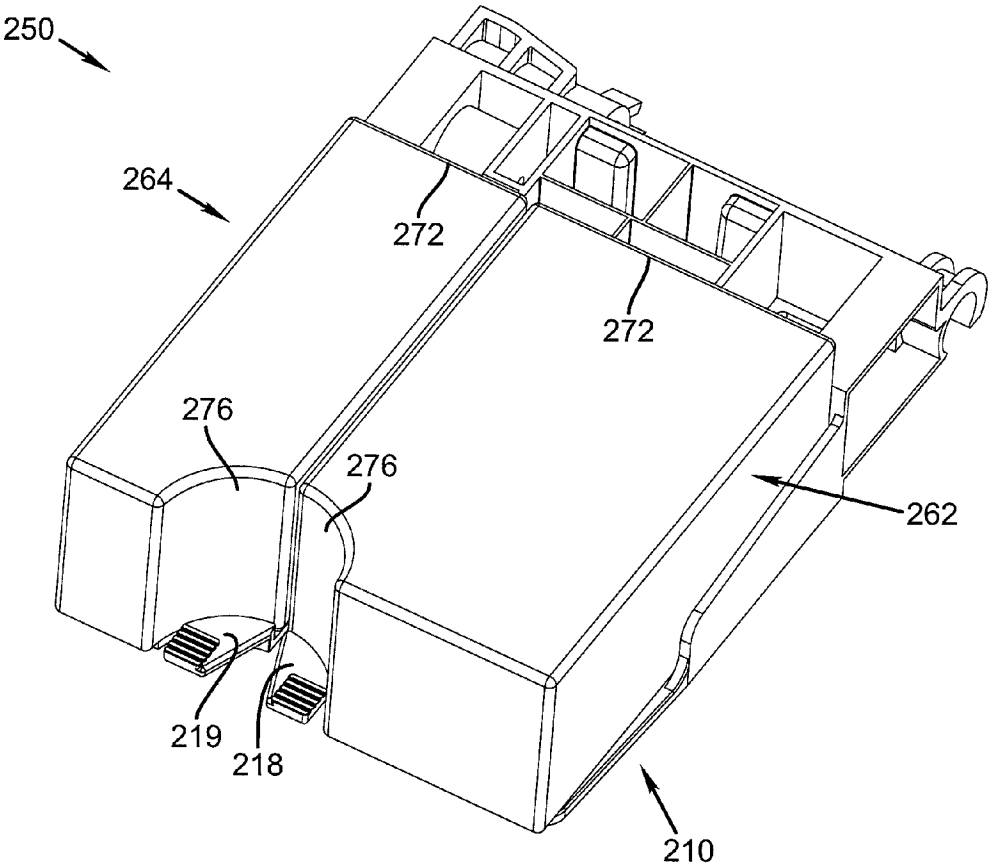
FIG. 4 is a perspective view of the printhead frame of FIG. 3 with two detachable ink tanks installed in the holding receptacle.

FIG. 3 shows a front perspective view of printhead frame 250, according to an embodiment of the invention, including holding receptacle 210 for ink tanks 262 and 264 (see FIG. 4). As described in more detail in commonly assigned U.S. patent application Ser. No. 12/750,729 holding receptacle 210 includes a first part 211 for holding a multichamber ink tank 262 and a second part 212 for holding a single chamber ink tank 264. Holding receptacle 210 has a base surface 214 for supporting the ink tanks. Base surface 214 has a first end 215 and a second end 216 that is opposite first end 215. Tank latch 218 is located near the first end 215 of the base surface 214 of first part 211 of holding receptacle 210, and tank latch 219 is located near the first end 215 of the base surface 214 of second part 212 of holding receptacle 210 for retaining the respective ink tanks. Wall 220 is located near the second end 216 of base surface 214 and adjoins base surface 214. Wall 220 (also called first wall 220 herein) includes ink inlet ports 224, 226 and 228 corresponding to first part 211 of holding receptacle 210, and also includes ink inlet port 222 corresponding to second part 212 of holding receptacle 210. Ink inlet ports 222, 224, 226 and 228 are connected to ink chambers 202, 204, 206 and 208, as is described in more detail below. The ink inlet ports are configured to receive ink from ink tanks 262 and 264 from ink outlet ports (not shown) at end walls 272 of ink tanks 262 and 264. Partition 230 adjoins both base surface 214 and wall 220, and is located between a portion of first part 211 and a portion of second part 212 of holding receptacle 210. First sidewall 232 of holding receptacle 210 also adjoins both base surface 214 and wall 220.

Second sidewall 234 of holding receptacle 210 is opposite first sidewall 232 and is substantially parallel to it. Partition 230 is located between first sidewall 232 and second sidewall 234. Partition 230 adjoins wall 220 between ink inlet port 222 and ink inlet port 224. Tank latches 218 and 219 are preferably cantilevered latches that extend from base surface 214 and latch against walls 276 of ink tanks 262 and 264 respectively. If cantilevered latch 218 or 219 is depressed along pressing direction 242, it can be relocated to an unlatching position, which is below base surface 214.

In some embodiments for a carriage printer, printhead frame 250 also has at least one bearing surface 248, which can be integrally formed together with holding receptacle 210. Bearing surface 248 is intended to ride on a carriage guide in the carriage printer so that printhead frame 250 also serves as the carriage. In fact, all of the labeled features in FIG. 3 can be integrally formed, for example, in a single injection molding step. This decreases the cost of forming assembling the printhead and carriage while retaining the required functionality. It can also make the design more compact.

Figure 5:
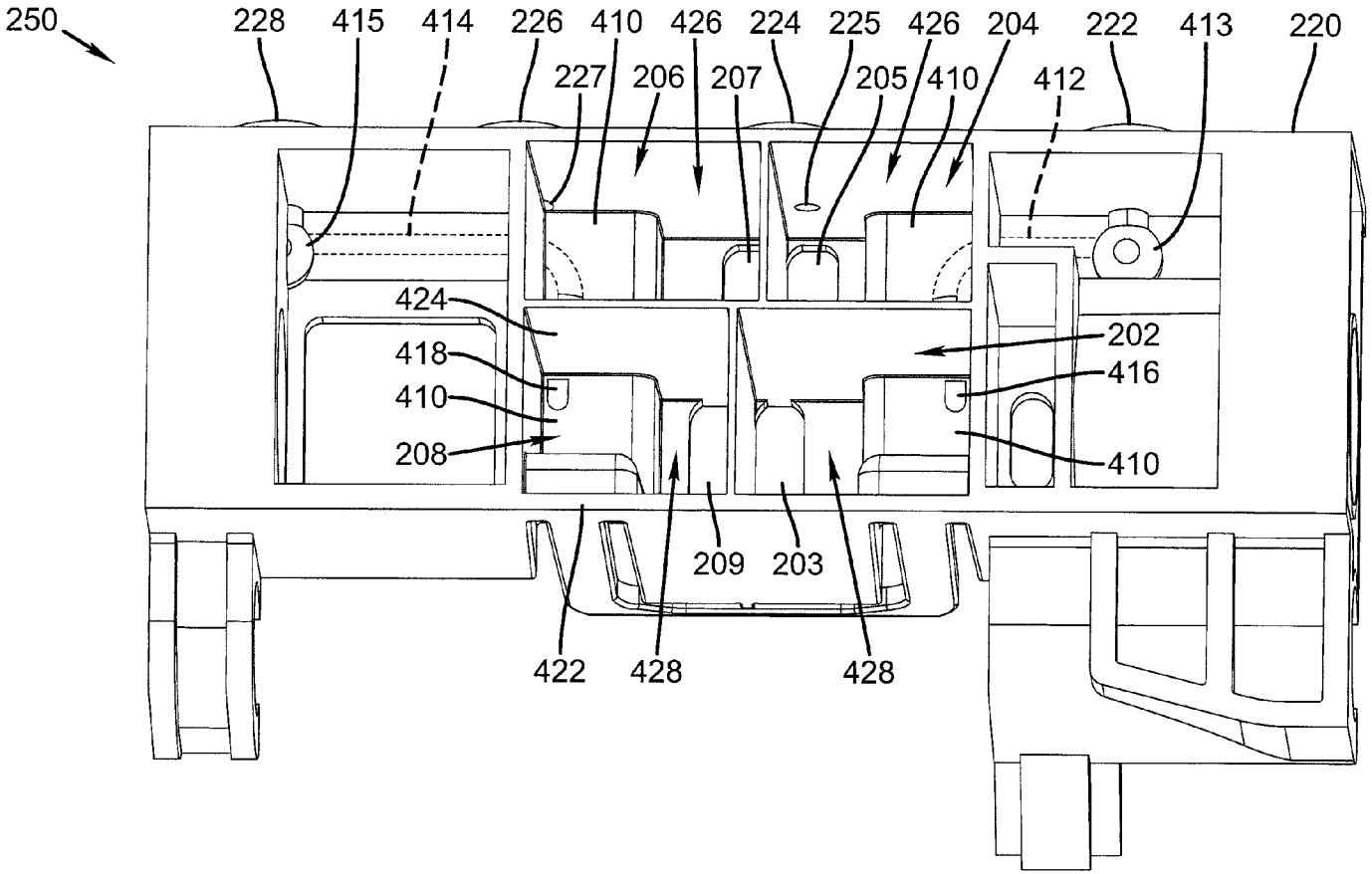
FIG. 5 is a close-up perspective view of the printhead frame of FIG. 3, according to an embodiment of the invention.
Figure 6:
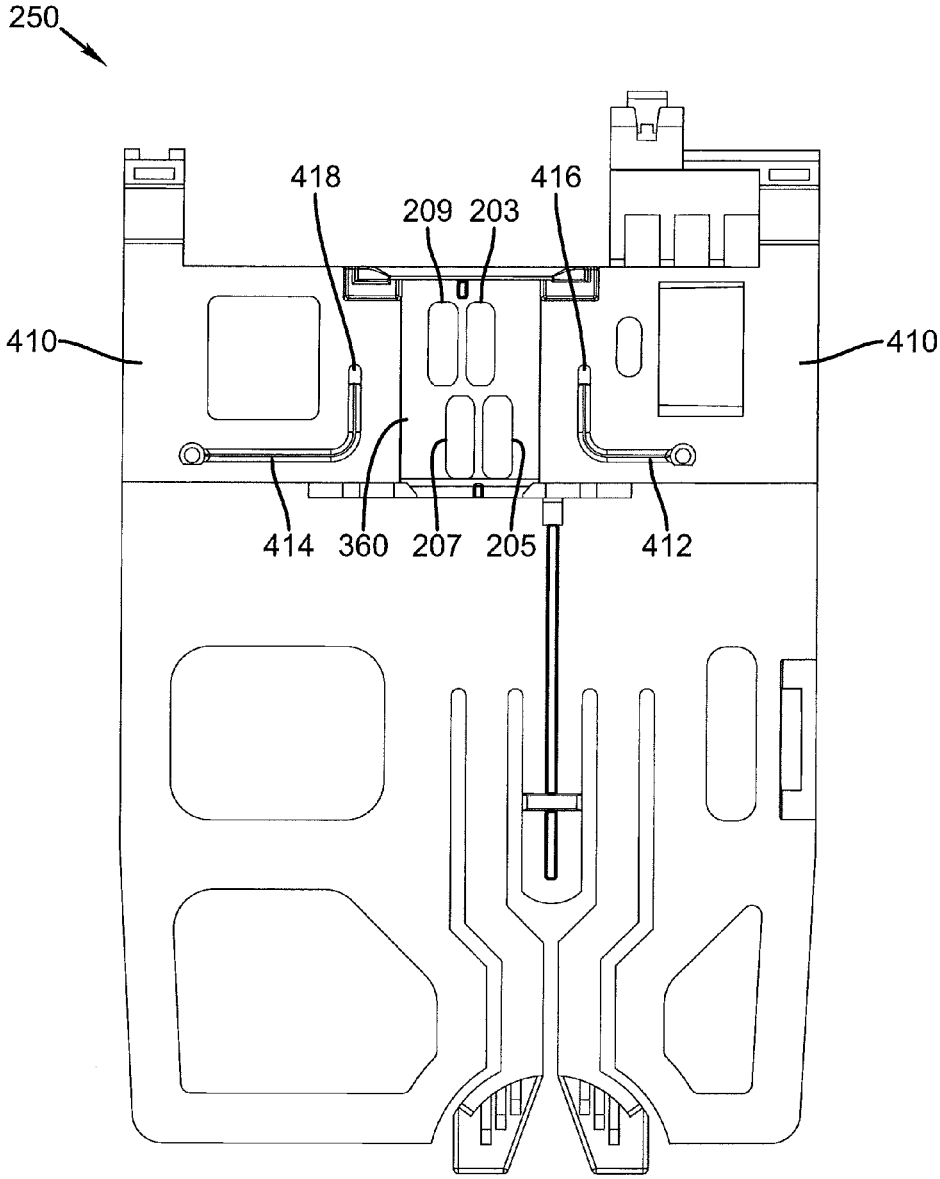
FIG. 6 is a bottom view of the printhead frame of FIG. 3, according to an embodiment of the invention.

As shown in FIG. 4, ink chambers 204 and 206 are located adjacent wall 220, on the opposite side of which their corresponding ink inlet ports 224 and 226 are located. The viewing angle of FIG. 5 makes it more readily apparent than for the viewing angle of FIG. 4 that first ink chamber 204 is directly opposite ink inlet port 224 and therefore can be connected to ink inlet port 224 by first hole 225 through wall 220. Similarly third ink chamber 206 is directly opposite ink inlet port 226 and therefore can be connected to ink inlet port 226 by third hole 227 through wall 220. By contrast, ink chambers 202 and 208 are not adjacent wall 220 so they cannot be directly connected to their respective ink inlet ports 222 and 228 by only a hole through wall 220. As shown in FIGS. 3, 5 and 6, a bottom wall 410 adjoins wall 220 and forms a part of ink chamber 202 (and also part of ink chambers 204, 206 and 208). A first groove 412 is formed in the side of bottom wall 410 (also called second wall 410 herein) that is opposite the interior of ink chamber 202. A second hole 223 through first wall 220 connects ink inlet port 222 to first groove 412 at hub 413. First groove 412 passes below ink chamber 204 but does not connect to ink chamber 204. A first hole 416 in bottom wall 410 fluidly connects second ink chamber 202 to first groove 412. In a similar fashion, a second groove 414 is formed in the side of bottom wall 410 that is opposite the interior of ink chamber 206. A fourth hole 229 through first wall 220 connects ink inlet port 228 to second groove 414 at hub 415. Second groove 414 passes below ink chamber 206 but does not connect to ink chamber 206. A second hole 418 in bottom wall 410 fluidly connects fourth ink chamber 208 to second groove 413.

As seen in FIG. 5, the configuration of ink chambers can also be described relative to a third wall 422 that is substantially parallel to first wall 220, and a fourth wall 424 that is located between first wall 220 and third wall 422. First ink chamber 204 and third ink chamber 206 are located between first wall 220 and fourth wall 424. Second ink chamber 202 and fourth ink chamber 208 are located between third wall 422 and fourth wall 424.

Figure 7:
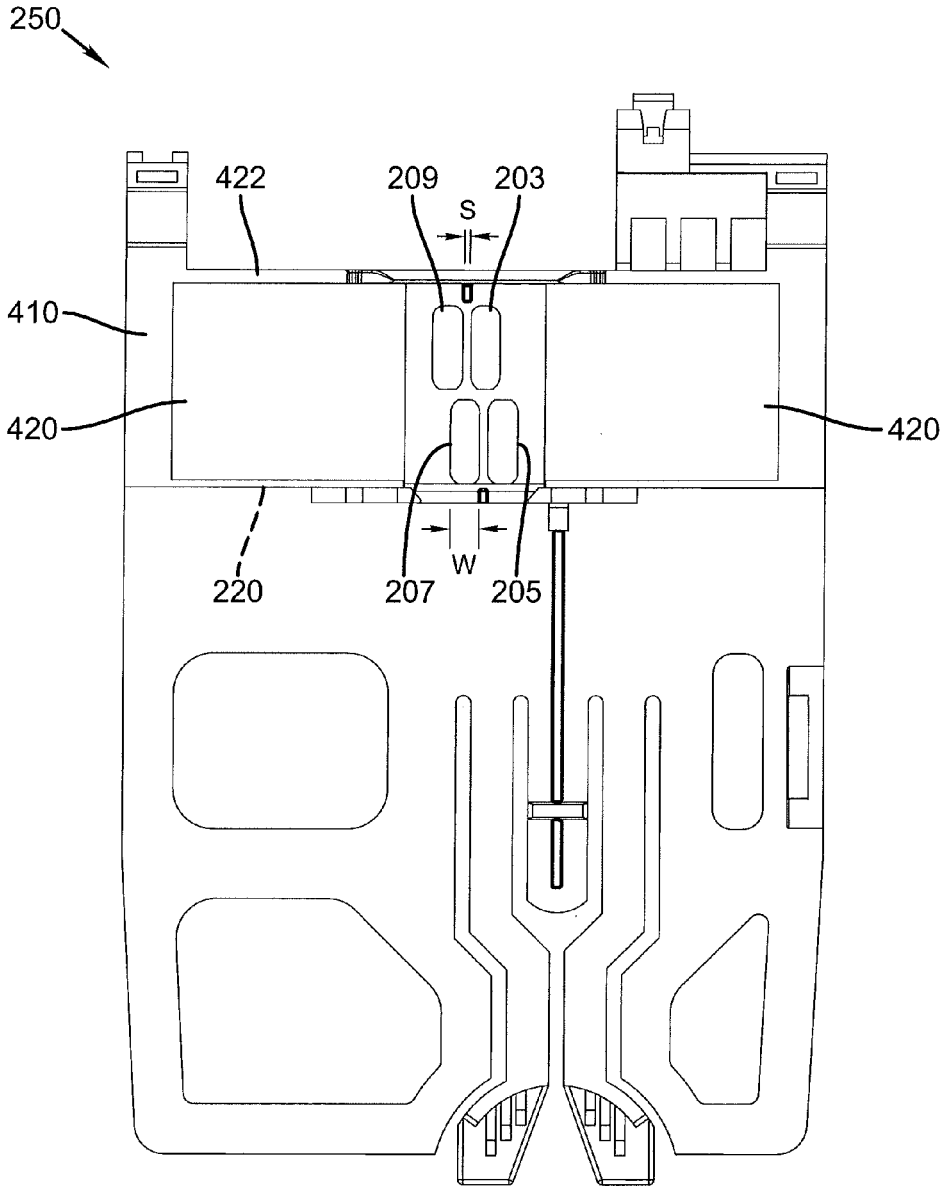
FIG. 7 is similar to FIG. 6, but also including cover plates sealing off grooves to complete ink passageways.

The portions of the printhead frame 250 described thus far (including the holding receptacle 210; the ink inlet ports 222, 224, 226 and 228; the ink chambers 202, 204, 206 and 208; the wall 220; the bottom wall 410; the holes 223, 225, 227 and 229 in wall 220; the grooves 412 and 414 in bottom wall 410; the hubs 413 and 415; and the holes 416 and 418 in bottom wall 410) can all be integrally formed by injection molding. However, in order to provide fully contained ink passageways from ink inlet ports 222 and 228 to ink chambers 202 and 208 respectively, grooves 412 and 414 need to be sealed off. FIG. 7 shows a bottom view that is similar to FIG. 6, but in FIG. 7 cover plates 420 have been adhered to bottom wall 410 in order to cover first groove 412 and second groove 414, thereby providing a completed ink passageway from ink inlet port 222 to ink chamber 202, and a completed ink passageway from ink inlet port 228 to ink chamber 208. The term "cover plate" is intended to include a rigid structural member or alternatively, a flexible film such as a tape.

Ink chambers 202, 204, 206 and 208 have corresponding ink chamber outlets 203, 205, 207 and 209 respectively for delivering ink to an ink delivery surface 360 shown in FIG. 6. As shown in FIG. 2, printhead die 251 are mounted on die mount substrate 310, which is attached to printhead frame 250 in a location next to ink delivery surface 360 (not shown in FIG. 2). As is detailed in commonly assigned U.S. patent application Ser. No. 12/750,744 slot openings in an ink receiving surface of die mount substrate 310 are aligned to the corresponding ink chamber outlets (also called ink delivery openings). Printhead die 251, ink delivery surface 360 and ink chamber outlets 203, 205, 207 and 209 occupy a significantly narrower region of printhead frame 250 than do the ink inlet ports 222, 224, 226 and 228, as is seen most clearly in FIG. 5. Ink inlet ports 222, 224, 226 and 228 are disposed in a row of ink inlet ports on wall 220. Ink inlet port 222 is a first outer inlet port at a first end of the row, and ink inlet port 228 is a second outer inlet port at a second end of the row. Ink inlet ports 224 and 226 are inner ink inlet ports that are disposed between outer ink inlet ports 222 and 228. Inner ink inlet ports 224 and 226 are closer to the ink chambers 204 and 206 than outer ink inlet ports 222 and 228. As a result, as described above, inner ink inlet ports 224 and 226 can be fluidly connected to corresponding ink chambers 204 and 206 respectively by providing first hole 225 and third hole 227 respectively through wall 220. As seen in FIGS. 3 and 5, outer ink inlet port 222 is fluidly connected to ink chamber 202 by second hole 223 through first wall 220, first groove 412 in bottom wall 410, and first hole 416 in bottom wall 410. Similarly, outer ink inlet port 228 is fluidly connected to ink chamber 208 by fourth hole 229 through first wall 220, second groove 414 in bottom wall 410, and second hole 418 in bottom wall 410.

Figure 8:
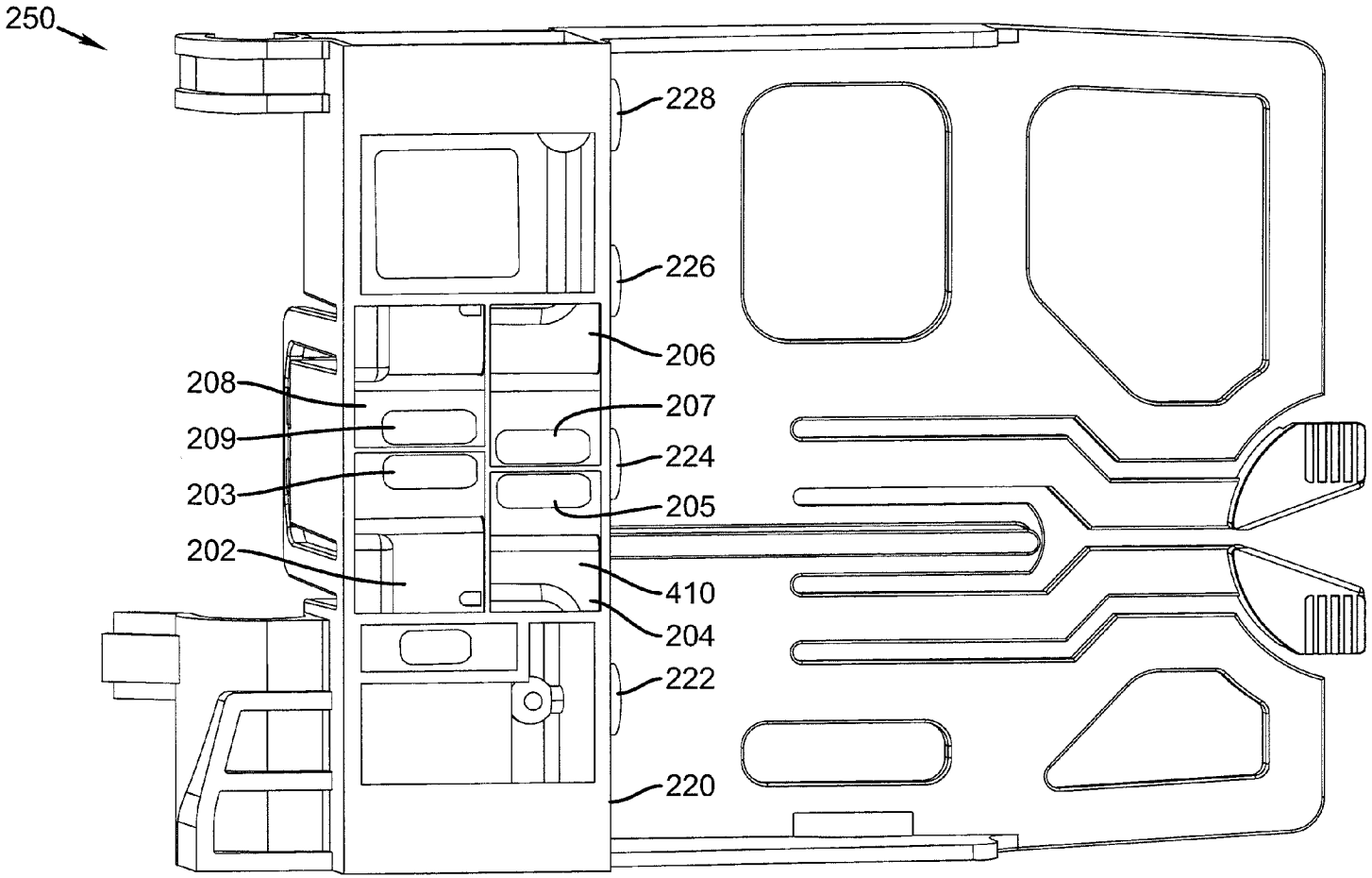
FIG. 8 is a top view of the printhead frame of FIG. 3, according to an embodiment of the invention.

In the top view of FIG. 8 of an embodiment of the invention, regions corresponding to grooves 412 and 414 that are on the opposite side of bottom wall 410 have been reinforced with additional injection molded material on the ink chamber side of printhead frame 250. The grooves themselves are not visible in the view of FIG. 8, but the reinforcing material is.

Figure 9:
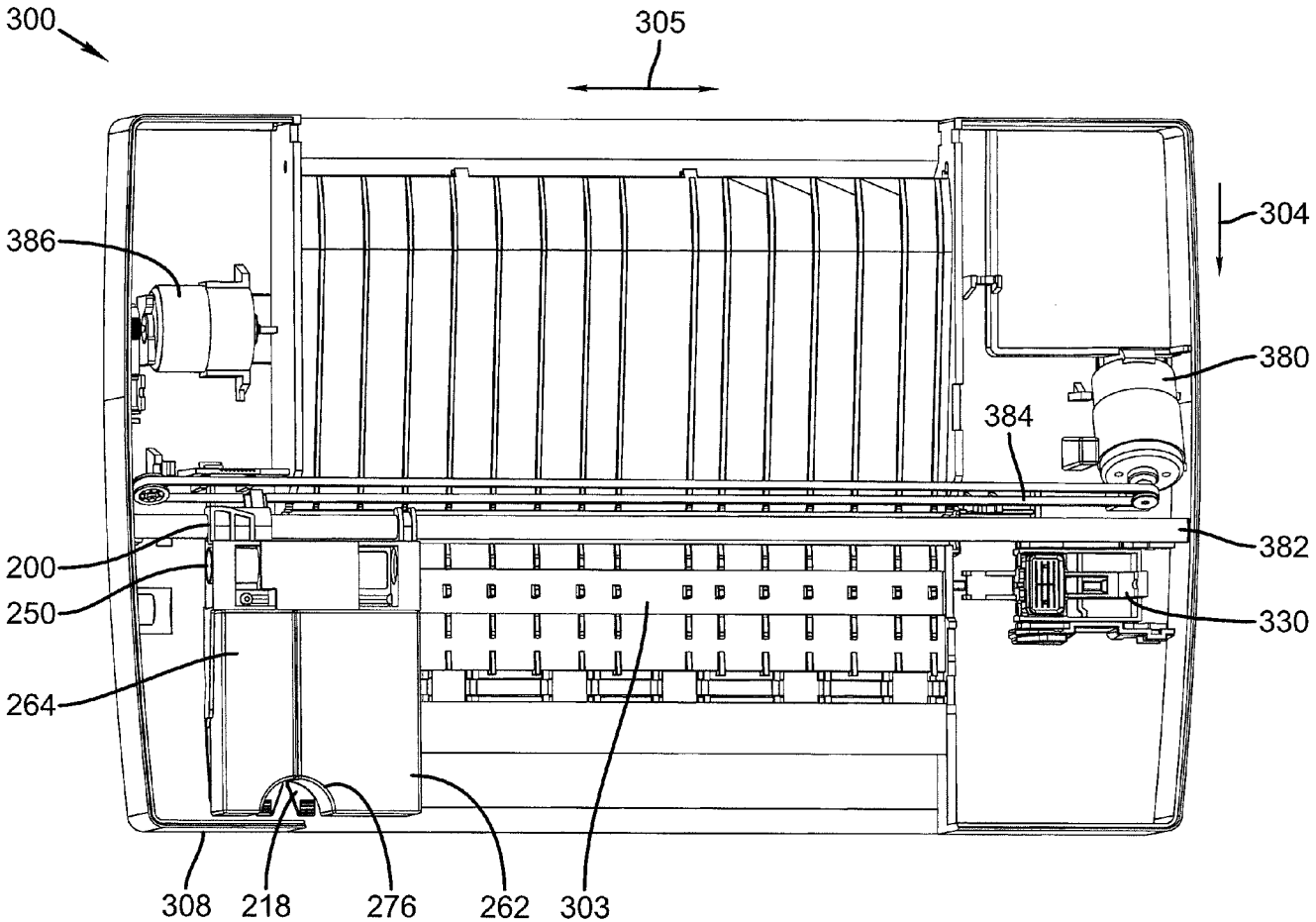
FIG. 9 is a top view of a portion of a carriage printer according to an embodiment of the invention.

In some embodiments, the ink chamber outlets corresponding to ink chambers 202, 204, 206 and 208 are disposed in cavities that are recessed relative below bottom wall 410. In the viewing angle of FIG. 5, cavities 426 and 428 are seen most clearly for chambers 206 and 208 respectively. Similarly first ink chamber 204 includes a first cavity 426 having a first ink outlet opening 205 located near first wall 220, and second ink chamber 202 includes a second cavity 428 having a second ink outlet opening 203 located near third wall 422. Providing such a staggered configuration of ink outlet openings (also shown in FIG. 8) facilitates fluidic connection to the die mount substrate 310 (FIG. 2), and from there to the nozzle arrays 253 on printhead die 251. Another advantage of the staggered configuration of ink outlet openings is that the openings can be made wider for better flow of ink toward die mount substrate 310, as well as better removal of air bubbles away from die mount substrate 310. This is illustrated in FIG. 7, where it is seen that ink chamber outlets 203 and 209 are separated by a distance s that is less than the width w of ink chamber outlet 205. In other words, the separation s between two ink chamber outlets in ink chambers corresponding to outer ink inlet ports is less than the width w of an ink chamber outlet in an ink chamber corresponding to an inner ink inlet port. Similarly, the separation between two ink chamber outlets in ink chambers corresponding to inner ink inlet ports 205 and 207 is less than the width of an ink chamber outlet 209 in an ink chamber corresponding to an outer ink inlet port FIG. 9 shows a top view of a desktop carriage printer 300 according to an embodiment of the present invention. Some of the parts of the printer have been hidden in the view shown in FIG. 9 so that other parts can be more clearly seen. Printer 300 has a print region 303 across which carriage 200 is moved back and forth in carriage guide direction 305, while drops are ejected from nozzle array 253 on printhead die 251 (not shown in FIG. 9) on printhead frame 250 that is mounted on carriage 200. Die mount substrate 310 (not shown in FIG. 9) is aligned to printhead frame 250 such that nozzle arrays 253 are disposed along a nozzle array (FIG. 2) direction 254 that is substantially perpendicular to carriage guide direction 305. In some embodiments, printhead frame 250 is integrally formed with carriage 200 as described above. Carriage motor 380 moves belt 384 to move carriage 200 along carriage guide 382.

Multichamber ink tank 262 and single chamber ink tank 264 are mounted in the holding receptacle of printhead frame 250. Tank latch 218 latches against wall 276 of multichamber ink tank 262. Printer 300 includes a base 309 on which the printer rests during operation (see FIGS. 10 and 11). A front wall 308 extends upward from base 309. To facilitate compact design and reduced cost of printer 300, the ends of tank latch 218 and tank latch 219 are disposed less than 5 mm from an interior surface of the front wall 308 of printer 300. The mounting orientation of printhead frame 250 is rotated relative to the view in FIG. 2 so that the printhead die 251 are located at the bottom side of printhead frame 250, the droplets of ink being ejected downward onto the paper or other recording medium (not shown) in print region 303. Paper advance motor 386 is shown but the various rollers that move the paper along media advance direction 304 are not shown in FIG. 17. Maintenance station 330 is provided for wiping and capping the nozzle face.

Figure 10:
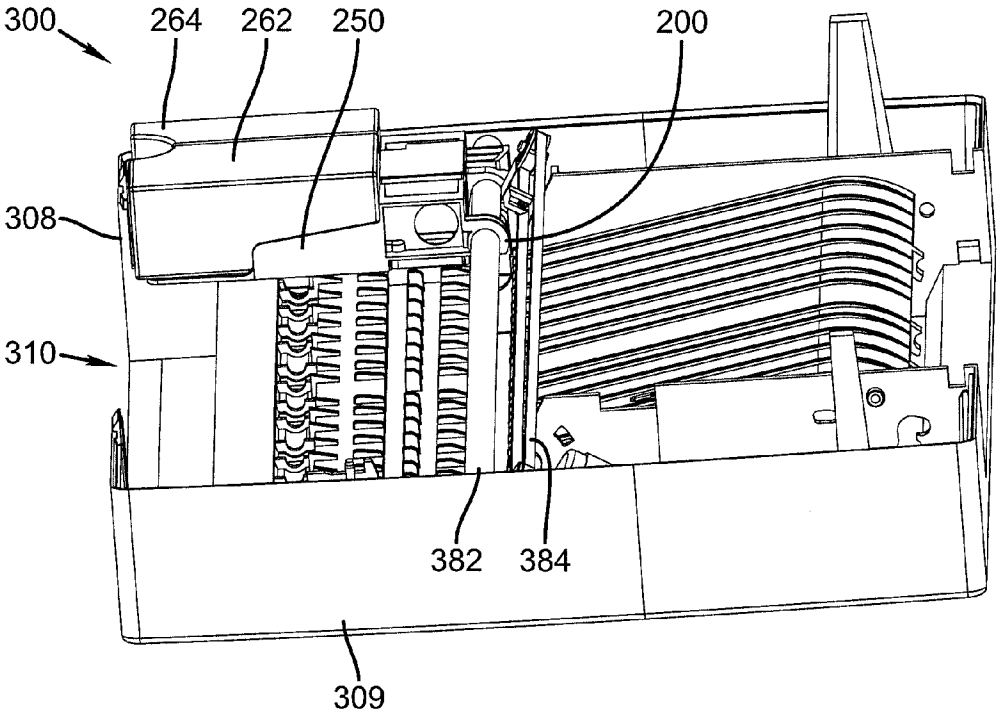
FIGS. 10 and 11 are perspective views of the carriage printer of FIG. 9.
Figure 11:
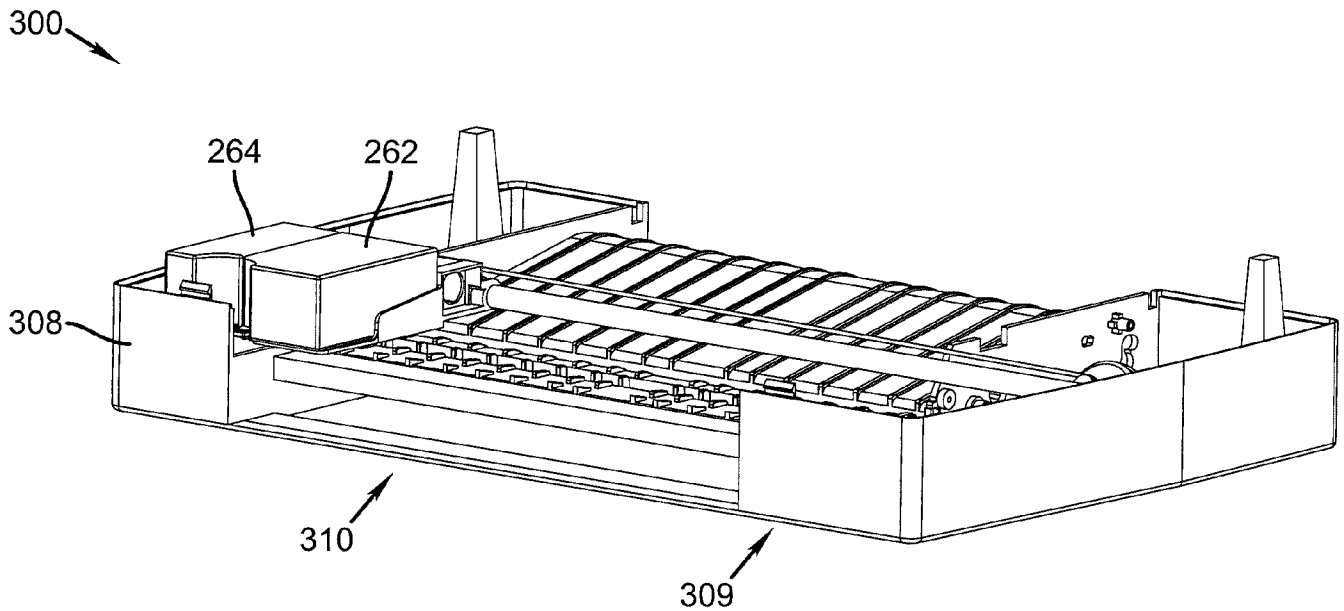

FIGS. 10 and 11 more clearly show front wall 308 of printer 300 and a doorway 310 through which the ink tanks 262 and 264 can be accessed for horizontal installation and removal. Printer 300 also includes a top surface (not shown), but the user can reach through doorway 310. Doorway 310 can consist of an opening as shown in FIGS. 10 and 11, or it can also optionally include a door (not shown) that the user can open in order to access the ink tanks 262 and 264. When an ink tank needs to be replaced, the carriage 200 is moved along carriage guide 382 until the ink tanks are located next to doorway 310. The user reaches through doorway 310 and releases the tank latch 218 or 219 corresponding to the ink tank 262 or 264 and grasps an end of the ink tank at the recessed connecting wall. The ink tank is then removed horizontally through the doorway 310. A replacement ink tank can then be inserted horizontally through doorway 310. The user can slide the replacement ink tank horizontally into the holding receptacle. After gently depressing the latching member as the ink tank is inserted into the holding receptacle, the latching member can be released so that it latches against the connecting wall 276 of the ink tank.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
202 Ink chamber
203 Ink chamber outlet
204 Ink chamber
205 Ink chamber outlet
206 Ink chamber
207 Ink chamber outlet
208 Ink chamber
209 Ink chamber outlet
210 Holding receptacle
211 First part (of holding receptacle)
212 Second part (of holding receptacle)
214 Base surface
215 First end
216 Second end
218 Tank latch
219 Tank latch
220 Wall (first wall)
222 Ink inlet port
223 Second hole (in first wall)
224 Ink inlet port
225 First hole (in first wall)
226 Ink inlet port
227 Third hole (in first wall)
228 Ink inlet port
229 Fourth hole (in first wall)
230 Partition
232 First sidewall
234 Second sidewall
242 Pressing direction
248 Bearing surface
250 Printhead frame
251 Printhead die
253 Nozzle array
254 Nozzle array direction
262 Multi-chamber ink tank
264 Single-chamber ink tank
272 End wall (of ink tank)
276 Wall (of ink tank)
300 Printer
303 Print region
304 Media advance direction
305 Carriage scan direction
308 Front wall (of printer)
309 Base (of printer)
310 Die mount substrate

312 Die mount surface
330 Maintenance station
360 Ink delivery surface
380 Carriage motor
382 Carriage guide rail
384 Belt
386 Paper advance motor
410 Bottom wall (second wall)
412 First groove
413 Hub
414 Second groove
415 Hub
416 First hole (in bottom wall)
418 Second hole (in bottom wall)
420 Cover plate(s)
422 Third wall
424 Fourth wall
426 First cavity
428 Second cavity

The invention claimed is:

1. A printhead frame for an inkjet printhead assembly, the printhead frame comprising:

(a) a holding receptacle for at least one replaceable ink tank, the holding receptacle including a plurality of ink inlet ports disposed on a first wall;

(b) a plurality of ink chambers corresponding to the plurality of ink inlet ports, wherein at least a first ink chamber is adjacent the first wall and is directly opposite a first ink inlet port, a second ink chamber is not adjacent the first wall, and the first wall includes a first hole to fluidly connect the first ink inlet port and the first ink chamber; and (c) a second wall adjoining the first wall and forming a part of the second ink chamber, the second wall including a first groove; wherein the first wall includes a second hole to fluidly connect a second ink inlet port and the first groove; and wherein the second wall includes a first hole to fluidly connect the second ink chamber and the first groove.

2. The printhead frame of claim 1, wherein the holding receptacle, the plurality of ink inlet ports, the plurality of ink chambers, the first wall, the second wall, the first and second holes in the first wall, the first groove in the second wall, and the first hole in the second wall are all integrally formed by injection molding.

3. The printhead frame of claim 1 further comprising a cover plate adhered to the second wall to cover at least a portion of the first groove in the second wall, thereby providing an ink passageway between the second ink inlet port and the second ink chamber.

4. The printhead frame of claim 1, the plurality of ink inlet ports being disposed in a row on the first wall, wherein the row of ink inlet ports includes:

a first outer ink inlet port at a first end of the row;

a second outer ink inlet port at a second end of the row; and at least one inner ink inlet port disposed between the first outer port and the second outer port.

5. The printhead frame of claim 4, wherein the first ink inlet port is an inner ink inlet port and the second ink inlet port is an outer ink inlet port.

6. The printhead frame of claim 4 further comprising:

a third wall substantially parallel to the first wall; and a fourth wall disposed between the first wall and the third wall, wherein the first ink chamber is located between the first wall and the fourth wall, and wherein the second ink chamber is located between the third wall and the fourth wall.

7. The printhead frame of claim 6 further comprising:

a third ink chamber located between the first wall and the fourth wall; and a fourth ink chamber located between the third wall and the fourth wall, wherein the third ink chamber is fluidly connected to a third ink inlet port by a third hole in the first wall, and wherein the fourth ink chamber is fluidly connected to a fourth ink inlet port by:

a fourth hole in the first wall;

a second groove in the second wall; and a second hole in the second wall.

8. The printhead frame of claim 7, wherein the first ink inlet port and the third ink inlet port are inner ports, and wherein the second ink inlet port and the fourth ink inlet port are outer ports.

9. The printhead frame of claim 8, the ink chambers each including a corresponding ink outlet, wherein the separation between the ink outlets in two chambers that are fluidly connected to outer ports is less than the width of an ink outlet in an ink chamber connected to an inner ink inlet port.

10. The printhead frame of claim 8, the ink chambers each including a corresponding ink outlet, wherein the separation between the ink outlets in two chambers that are fluidly connected to inner ports is less than the width of an ink outlet in an ink chamber connected to an outer ink inlet port.

11. The printhead frame of claim 6, wherein the first ink chamber includes a first cavity having a first ink outlet opening proximate the first wall, and wherein the second ink chamber includes a second cavity having a second ink outlet opening proximate the third wall.

12. The printhead frame of claim 1 further comprising a bearing surface configured to ride on a carriage guide in an inkjet printer.

13. An inkjet printer comprising:

(a) a carriage guide including a carriage guide direction;

(b) a first nozzle array including nozzles disposed along a nozzle array direction;

(c) a second nozzle array including nozzles disposed along the nozzle array direction;

(d) at least one replaceable ink tank; and (e) a printhead frame comprising:

(i) a holding receptacle for at least one replaceable ink tank, the holding receptacle including a plurality of ink inlet ports disposed on a first wall;

(ii) a plurality of ink chambers corresponding to the plurality of ink inlet ports, wherein at least a first ink chamber is adjacent the first wall and is directly opposite a first ink inlet port, a second ink chamber is not adjacent the first wall, and the first wall includes a first hole to fluidly connect the first ink inlet port and the first ink chamber; and (iii) a second wall adjoining the first wall and forming a part of the second ink chamber, the second wall including a first groove; wherein the first wall includes a second hole to fluidly connect a second ink inlet port and the first groove; and wherein the second wall includes a first hole to fluidly connect the second ink chamber and the first groove.

14. The inkjet printer of claim 13, the plurality of ink inlet ports being disposed in a row on the first wall, wherein the first wall is substantially parallel to the carriage guide direction, and wherein the row of ink inlet ports includes:

a first outer ink inlet port at a first end of the row;

a second outer ink inlet port at a second end of the row; and at least one inner ink inlet port disposed between the first outer port and the second outer port.

15. The inkjet printer of claim 14, wherein the first ink inlet port is an inner ink inlet port and the second ink inlet port is an outer ink inlet port.

16. The inkjet printer of claim 14, wherein the printhead frame further comprises:

a third wall substantially parallel to the first wall; and a fourth wall disposed between the first wall and the third wall, wherein the first ink chamber is located between the first wall and the fourth wall, and wherein the second ink chamber is located between the third wall and the fourth wall.

17. The inkjet printer of claim 16, wherein the first ink chamber includes a first cavity having a first ink outlet opening proximate the first wall, and wherein the second ink chamber includes a second cavity having a second ink outlet opening proximate the third wall.

18. The inkjet printer of claim 13, wherein the printhead frame further comprises a bearing surface configured to ride on the carriage guide.

* * * * *